United States Patent [19]

Ricks et al.

[11] 3,964,554

[45] June 22, 1976

[54] TEMPERATURE-REGULATED, SEALED BEARING SYSTEM FOR ROCK DRILL BITS

[75] Inventors: Robert E. Ricks, Los Angeles; William P. Robinson, Palos Verdes, both of Calif.

[73] Assignee: Smith International, Inc., Newport Beach, Calif.

[22] Filed: Dec. 30, 1974

[21] Appl. No.: 537,191

[52] U.S. Cl. ..... 175/17; 175/359; 175/371; 175/228

[51] Int. Cl.[2] ..... E21B 9/08

[58] Field of Search ..... 175/17, 39, 228, 337, 175/370, 359, 371, 372, 340, 356; 308/8.2; 184/6.22

[56] References Cited

UNITED STATES PATENTS

| | | | |
|---|---|---|---|
| 945,209 | 1/1910 | Avery | 175/17 |
| 1,870,696 | 8/1932 | Taylor | 175/17 |
| 2,184,067 | 12/1939 | Zublin | 175/340 |
| 2,861,780 | 11/1958 | Butler | 175/17 |
| 3,062,302 | 11/1962 | Toth et al. | 175/39 |
| 3,113,630 | 12/1963 | Williams | 175/371 X |
| 3,163,695 | 12/1964 | Bumberger | 308/77 |
| 3,650,337 | 3/1972 | Andrews et al. | 175/17 |
| 3,706,483 | 12/1972 | Irwin | 308/77 |
| 3,788,408 | 1/1974 | Dysart | 175/337 |
| 3,866,695 | 2/1975 | Jackson | 175/228 |

*Primary Examiner*—Ernest R. Purser
*Assistant Examiner*—Richard E. Favreau

[57] ABSTRACT

An invention relating to a rock drill bit assembly primarily adapted for earth boring operations, and more particularly to a rock drill bit assembly having therewithin a temperature-controlled, sealed environ being adapted for the bearing means and the lubricant disposed between the relatively rotatable parts thereof.

The rock drill bit assembly includes a rock drill main body having a journal thereon with an internally confined heat exchange means therein which is selectively controlled by a remotely located control system, at least one cone which is relatively rotatably supported from the journal facial surface, a peripheral seal adapted for fully enclosing the clearance space defined between the relatively rotatable opposing facial surfaces of the journal and the cone, and bearing means and lubricant positioned in the enclosed clearance space and adapted for reducing rotational friction between the opposing facial surfaces thereof.

Under temperature-elevated earth boring conditions, the selectively controlled heat exchange means are maintained at a relatively low temperature so that heat transfer is induced endothermically from the bearing means and lubricant to the heat exchange means.

Under frigid earth boring conditions, the selectively controlled heat exchange means are maintained at a relatively elevated temeperature so that heat transfer is induced exothermically from the heat exchange means to the bearing means and lubricant.

6 Claims, 8 Drawing Figures

TEMPERATURE-REGULATED, SEALED BEARING SYSTEM FOR ROCK DRILL BITS

BACKGROUND OF THE INVENTION

1. Field of the Invention

The present invention relates to a rock drill bit assembly primarily adapted for earth boring operations, and more particularly, to an improved rock drill bit assembly having therein a temperature-controlled, sealed environ adapted for the bearing means and lubricant disposed between the relatively rotatable parts thereof.

2. Prior Art

In the conventional earth boring operation, a rock drill bit assembly is fastened axially to the boring end of a drill string. At ground surface-level, with the drill string in the vertical position, torque is applied to the upper end of the drill string and transmitted vertically downward into the wellbore by the drill string and its rock drill bit assembly which cuts through the underlying geological formations with each successive rotation of the drill string assembly.

Generally, a rock drill bit assembly includes three basic components: a rock drill main body, at least one cone which is rotatably supported from a journal facial surface of said rock drill main body, and bearing means with their attendant lubricant positioned in the clearance space defined between the relatively rotatably opposed faces of the rock drill main body and the cone.

When a component element fails within the rock drill bit assembly during earth boring operations, it necessitates the costly operation of physically removing the entire drill string from the wellbore in order to have access to the assembly so as to replace or repair the rock drill bit assembly at ground surface-level. Accordingly, a conventional method used by the earth boring industry to economically evaluate rock drill bit assembly performance is to measure the linear footage bored prior to rock drill bit assembly failure.

Failure analysis of rock drill bit assemblies by technical experts in the earth boring industry indicates that bearing failure is the major cause of rock drill bit assembly failure. Their studies further indicate that temperature extremes during the earth boring operation destroy the lubricating properties of the lubricant or destroy the bearing means in a design where no lubricant is used, and that external contaminants present in the wellbore migrate into the clearance space between the relatively rotatably opposing faces of the rock drill main body and the cone, and that these contaminants being abrasive and corrosive in nature destroy the lubricant and bearing surfaces, and thus cause the bearing components contained therein to eventually bind, whereupon rock drill bit assembly failure occurs.

These failure analysis results bear out basic engineering theory that proper lubrication and correct temperature operating range are key factors in effecting long bearing life.

It was evident to the industry that a system using sealed lubricated bearing means would substantially prevent lubricant and bearing contamination, and that temperature-regulating means to protect the bearings and lubricant from temperature degradation within the rock drill bit assembly would greatly increase rock drill bit assembly life, and thus increase the linear footage which can be drilled per rock drill bit assembly prior to failure.

Thus, one conventional rock drill bit assembly currently in wide use and referred to as "unsealed bearing construction", is designed with a passageway in the rock drill main body which communicatively connects downhole drilling fluid in the drill string hollow core with the bearing means positioned in the clearance space defined between the rock drill main body journal facial surface and the opposing facial surface of the cone. A portion of the downhole drilling fluid is forced through this connecting passageway into the clearance space defining the bearing means environ, wherein said fluid serves to lubricate and cool the bearing elements, whereafter the spent fluid exits into the wellbore. This method of bearing cooling and lubrication causes corrosive and erosive action upon the bearing means and their respective surfaces, and tends to introduce debris contaminants into the bearing environ wherein these contaminants eventually destroy the bearing means.

A second conventional rock drill bit assembly currently in wide use and referred to as "sealed bearing construction" is designed to provide lubrication to the rock drill bit assembly bearing means by incorporating an internal reservoir cavity within the core of the rock drill main body with an ingress connecting passageway thereto to accept and equalize pressure from the wellbore environ and transmit this equalization pressure to the reservoir cavity, and an egress connecting passageway from said reservoir cavity to the bearing means environ wherein lubricant from the reservoir is transmitted to the bearing means. Lubricant stored in the reservoir is progressively squeezed therefrom so as to provide lubrication to the bearing means and their contact surfaces. In this system no direct provision is made for dissipating frictional heat generated during earth boring operations, said heat being conducted through the basically ferrous structure of the rock drill bit assembly to the bearing means and lubricant therein, where excessive heat buildup eventually destroys the lubricant and the bearing means.

Some earth boring operations are conducted in the Artic relatively close to the surface level. Conditions exist in these Artic climes where the bearing means and lubricant are thus subjected to severe cold which impairs their operation, and shortens their life expectancy unless temperature-regulation means are provided thereto.

SUMMARY OF THE INVENTION

According to the present invention the temperature-regulated, sealed bearing system for the rock drill bit assembly operates under temperature-elevated conditions by the remotely located, control system communicatively signaling the heat exchanger to operate endothermically within the confines of the rock drill main bodies, as to induce heat transfer from the rock drill main body wall mass thereby cooling a journal facial surface thereon which is supporting the relatively rotatable cone, whereupon the relatively cooler supporting journal facial surface induces heat transfer from the bearing means and the lubricant in contact therewith, and from the sealing means peripherally disposed therearound, thus cooling same.

In the alternative, under frigid temperature conditions, the heat exchanger is controlled to operate exothermically so as to induce heat transfer from itself, through the rock drill main body thereby heating a journal facial surface thereon, whereupon the relatively warmer supporting journal heats the bearing means, lubricant and sealing means in contact therewith.

The environ, defined by the fully enclosed clearance space bounded by the relatively rotatable opposing faces of the rock drill main body and the cone and said sealing means, is thus temperature regulated internally so as to protect the bearing means, lubricant and sealing means from destructive temperature extremes, and is thus sealed externally so as to protect the bearing means and the lubricant from wellbore contaminants.

The primary advantage of the present invention is that it increases the life of the rock drill bit assembly by improving the lubrication of bearing means positioned in a sealed clearance space defined between the relatively rotatable opposing facial surfaces of the rock drill main body and the cone supported therefrom by maintaining the temperature of the bearing means and lubricant in said sealed clearance space within a defined temperature range by inducing heat transfer thereto or therefrom depending on boring conditions so as to prevent degradation of the lubricant, bearings and sealing means.

Another advantage of the present invention is that it provides a system for controlling said bearing and lubrication environ temperature by indirect means so that the bearing means and the lubricant will not be contaminated by foreign deleterious substances.

A further advantage of the present invention is that it provides a system for temperature-regulation which does not require egress means through the bearing means area, thereby permitting the use of a peripheral boundary seal around said temperature-controlled environ which will prevent ingress of downhole boring contaminants, and which will prevent egress of lubricant.

Although the invention is described with particularity in the appended claims, a more complete understanding of the invention may be obtained from the following detailed description of various preferred embodiments taken in conjunction with the appended drawings herein.

DETAILED DESCRIPTION OF THE PREFERRED EMBODIMENT

Structure

Figure 1:
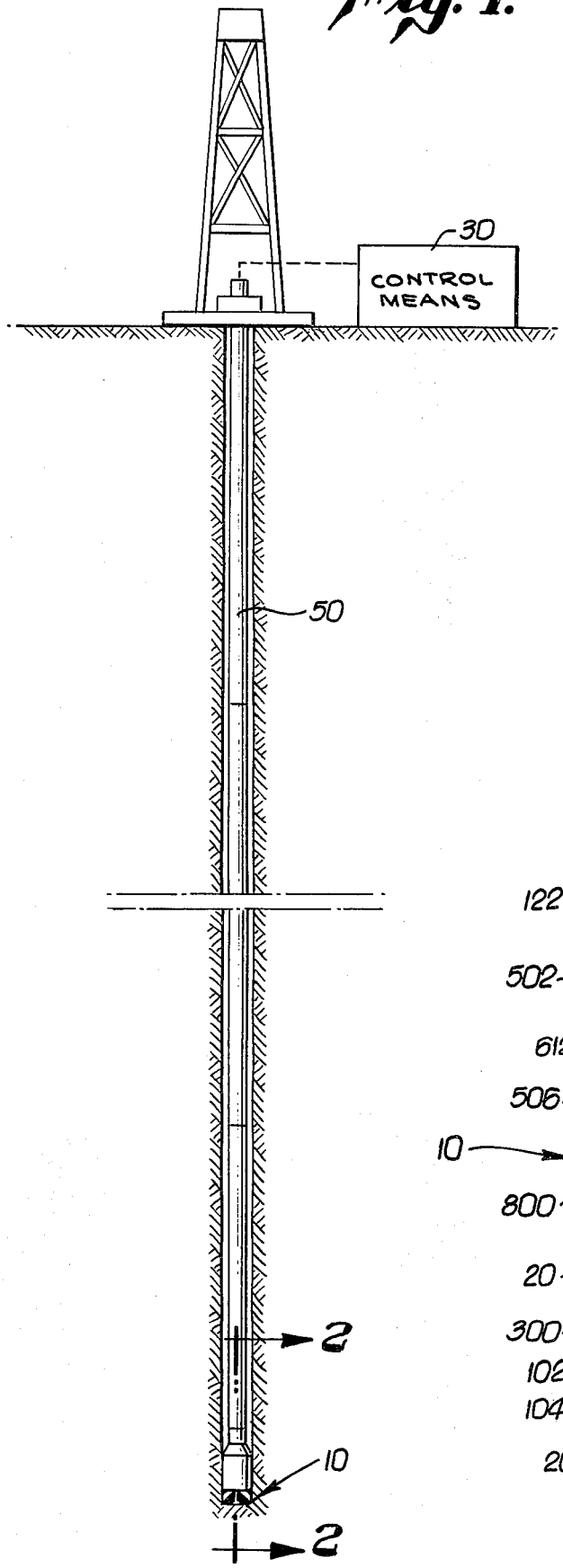
FIG. 1 is a pictorial schematic of the rock drill bit assembly connected to its supporting drill string, and said rock drill bit assembly being communicatively coupled to the remotely located control means.

Referring to FIGS. 1 through 4 inclusive, the present invention relates to a rock drill bit assembly 10 generally comprising; a rock drill main body 100 having an internally confined heat exchanger means 20 therein which is controlled from a remotely located, control system 30, at least one cone 200 relatively rotatably supported from a defined journal 151 facial surface 102 of said rock drill main body 100, a peripheral seal 300 adapted for forming an enclosing boundary for the clearance space 700 defined between the relatively rotatable faces 102, 202 of said rock drill main body 100 and said cone 200, and bearing means 400 and lubricant 500 therebetween adapted for reducing rotational friction.

The rock drill main body 100 is substantially cylindrical in form having an upper outer surface configuration adapted for coupling with the drill string 50 and having a lower outer journal facial surface 102 adapted for relatively rotatably supporting a cone 200 thereon, and said rock drill main body 100 having an inner cavity 150 therewithin adapted for conducting downhole fluid 600 for indirectly cooling or heating the bearing means 400, lubricant 500 and sealing means 300 and for conducting downhole fluid 600 for cleaning the cutting teeth 250 mounted in the cone 200 boring face and for cleaning the wellbore bottom surface being bored.

The outer configuration of the rock drill main body 100 is constructed with an upper end adapted for operatively coupling with the drill string 50 by a threaded connection 120 or other equivalent means. An exterior wall surface 122 descends downward from said threaded connection 120 so as to form the exterior sidewall 122 of the rock drill main body 100. The lower exterior end of the rock drill main body has at least one supporting journal 151 facial surface 102 which is adapted to relatively rotatably support the cone 200 opposing facial surface 202 thereto.

The inner configuration of the rock drill main body 100 can be constructed with two independent passageway circuits 612, 622 therein branching from the rock drill main body cavity 150. One passageway circuit 622 has egress from the drill string 50 immediately above and is adapted to conduct downhole drilling fluid 600 therethrough to a jet nozzle 640 positionally located in the base area of said rock drill main body 100 as to direct the nozzle flow onto and/or past the cutting teeth 250 mounted in the cone 200 boring facial surface.

The second passageway circuit 612, 613, 614 feeds from the rock drill main body cavity 150 and courses the fluid 610 therein through the core of the rock drill main body 100 by a continuous passageway comprising three basic sections 612, 613, 614 which induces heat transfer through the rock drill main body wall 152 to a journal 151 facial surface 102. After the fluid 610 has coursed through the passageway system 612, 613, 614, it exits through an exit port 617 in the sidewall 122 of the rock drill main body 100.

Depending upon the geological formations being encountered during specific earth boring operations, diverter 160 and/or deflector 170 means (FIGS. 5 and 6) are installed in the cavity 150 of the rock drill main body 100 so as to separate the desired constitutient of the downhole drilling fluid 600, such as water and/or air, and direct the desired separated water accumulation or air through the second passageway circuit 612, 613, 614 previously described.

The cone 200 is a substantially solid structure having a supported face 202 in substantially opposing parallel relationship with the opposing journal 151 facial surface 102 of the rock drill main body 100. An O-ring gland groove 208 is machined into the cone supported facial surface 202 and is adapted to retain a sealing means 300 so that the clearance space 700 defined between the opposing faces 102, 202 of the rock drill main body 100 and the cone 200 is fully enclosed by an annular sealing ring 300 therearound. The remaining exterior facial surface of the cone 200 is adapted to receivingly accept cutting teeth inserts 250 which contact the wellbore bottom surface and are adapted to cut through the underlying geological structure.

The clearance space 700 between the relatively opposing facial surfaces 102, 202 of the rock drill main body 100 and the cone 200, and which is peripherally enclosed by the sealing means 300 defines a temperature controlled environ wherein the bearing means 400 and the lubricant 500 are maintained at a temperature level within a desired temperature range by heat transfer induced by the heat exchange means.

Bearing means 400 may comprise ball bearings, roller bearings, bearing metals, or other suitable bearing designs adapted to reduce frictional forces between relatively rotatable surfaces 102, 202 of the rock drill main body 100 and the cone 200. The supporting journal 151 facial surface 102 of the rock drill main body 100 and the parallel opposing supported facial surface 202 of the cone 200 have mutually opposing defined depressions 104, 204 wherein said rock drill main body 100 facial surface 102 retainingly confines one portion of the exterior surface of said bearing means 400 and wherein said cone 200 opposing facial surface 202 mutually retainingly confines a portion of the remaining exterior surface of said bearing means 400.

Lubrication means have a reservoir 504 positioned in the rock drill main body 100 wherein lubricant 500 is retained. An ingress pressure equalization passageway 502 from the wellbore, pressurize balances the lubricant 500 in the reservoir 504. Lubricant 500 upon demand flows through the egress passageway 506 from the lubricant reservoir 504 to the bearing means 500 and their respective contact surfaces, whereupon the rock drill main body 100 journal facial surface 102 and the opposing cone 200 facial surface 202 operating in conjunction with sealing means 300 maintain and confine the lubricant 500 within a defined environ wherein the temperature is controlled within a defined temperature range.

Operation

A remotely located control means 30 is positioned near the upper end of the drill string 50 at ground surface-level. Depending upon the earth boring conditions, cooling or heating fluid 600 is pumped downward through the hollow core of the drill string 50 to the interior cavity 150 of the rock drill main body 100, which is a component part of the rock drill bit assembly 10 which defines the boring end of the drill string assembly.

The fluid 600 upon entering the rock drill main body 100, is divided into two streams 610, 620. One stream 620 enters a passageway 622 defining a courseway for forcing the fluid 620 through nozzle 640 which directs the exiting nozzle flow against the cutting teeth 250 of the cone 200 and also directs the nozzle flow against the bottom surface of the wellbore, thereby cleaning said teeth 250 and the wellbore bottom surface, and thus improving the boring action of the drill string assembly.

A second stream of fluid 610 is diverted from the rock drill main body 100 cavity 150 and is directed into a second passageway circuit 612, 613, 614 wherein the fluid contacts the wall mass 152 of the rock drill main body 100 journal 151 supporting facial surface 102, whereafter the spent fluid 616 flows out an exit port 617 in the sidewall 122 of the rock drill main body 100.

If the earth boring operations are commenced in frigid areas, the downhole drilling fluid 600 is heated to be exothermic so that as a portion of the fluid 610 passes through the internally confined passageway 612, 613, 614 of the rock drill main body 100 in the area adjacent to the supporting journal facial surface 102, temperature gradients are generated by the elevated temperature of the downhole fluid 610 which induces heat transfer from the circulating fluid 610 through the rock drill main body 100 journal wall 152 to the facial surface 102 defining a boundary surface of said temperature controlled environ. Controlled heat transfer to this facial surface 102, and therefrom transmitted to the environ defined by the enclosed clearance space 700 between the respectively opposing rotatable facial surfaces 102, 202 of the rock drill main body 100 and the cone 200, and the peripheral seal means 300 therearound, maintain the bearing means 400 and the lubricant 500 therein enclosed within a temperature range which insures substantially long life for the lubricant 500 and for the bearing means 400.

The sealing means 300 provides a dual function during the operation of the rock drill bit assembly 10. One function of the seal means 300 being to prevent wellbore fluid from mixing with the lubricant 500 or contaminating the bearing contact surfaces by defining an external barrier against these detrimental contaminents, and the second function of the seal means 300 being to retain the lubricant within said defined environ by defining an internal barrier against lubricant loss, thereby insuring the lubrication of the bearing means 400 and maintaining the lubricant 500 within the defined temperature range previously forementioned.

It should be noted herein that the sealing means 300 is usually constructed of a material which is deleteriously affected by temperature and thus said temperature controlled environ serves also to protect and increase the life expectancy of sealing means 300 in rock drill bit assemblies employing this type of seal.

In the alternative, where earth boring operations are commenced in geothermal areas or in many locales where excessive frictional heat buildup may occur in the rock drill bit assembly, the downhole fluid 600 is adapted to be endothermic and thus behave as a coolant so that heat transfer is induced from the defined temperature controlled environ to the cooling circulating fluid 610 flowing within said passageway circuit 612, 613, 614 coursing through the rock drill main body 100 supporting journal 151 and exiting 617 into the wellbore.

Alternate Forms

Several alternate forms of the present invention may be utilized to effect a temperature-regulated, sealed bearing system for the rock drill bit assembly 10. These alternate forms of the present invention apply the same basic methodology and principles as exemplified in the detailed description of the preferred embodiment which was used by the inventor to demonstrate the utility and improved performance of his present invention.

Figure 2:
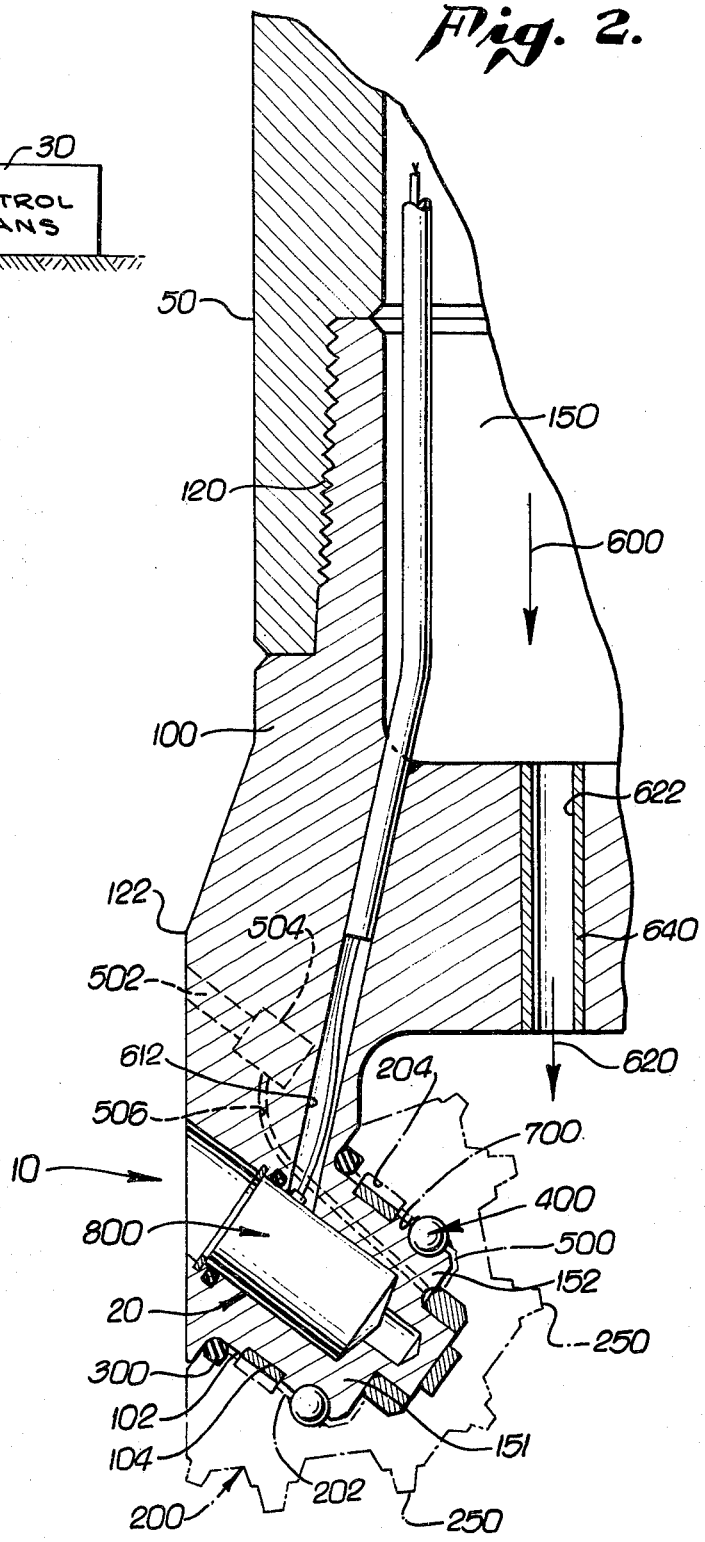
FIG. 2 is a fragmentary cross-sectional view of a rock drill bit assembly showing a remotely controllable heat exchange means therein.
Figure 3:
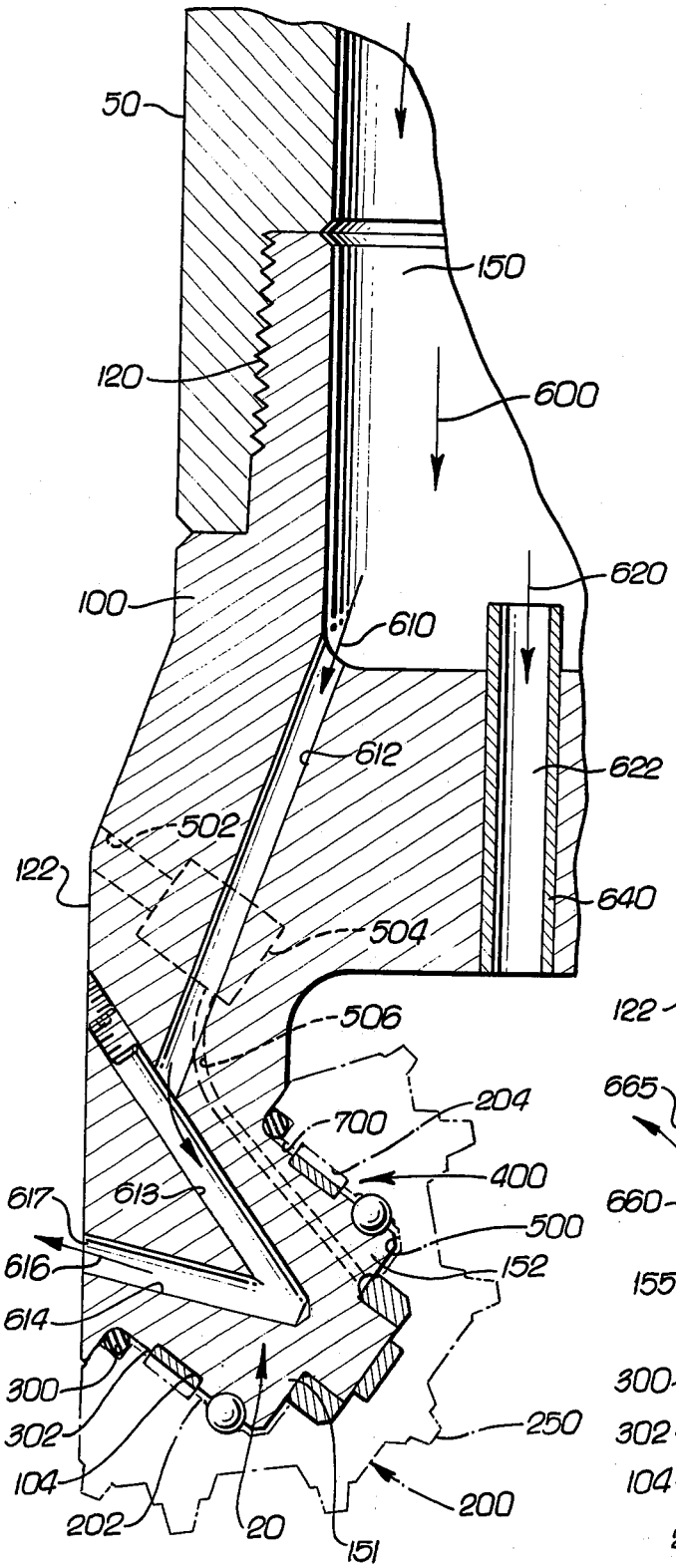
FIG. 3 is a fragmentary cross-sectional view of a rock drill bit assembly showing within the rock drill main body a passageway circuit with ingress from the drill string for accepting downhole fluid and said passageway circuit coursing said downhole fluid through the rock drill main body so as to heat or cool a supporting journal facial surface thereof, and said passageway circuit egressing into the wellbore.

One alternate form of the preferred embodiment FIG. 2 is to use electrical heat exchanger 800 as the means for effecting heat transfer from or to the rock drill main body 100 so as to temperature regulate the environ defined as the clearance space 700 between the relatively opposing faces 102, 202 of the rock drill main body 100 and the cone 200. This electrical heat exchange means 800 serves the dual capacity of being able to induce heating or cooling of the supporting journal 151 facial surface 102 as earth boring conditions so dictate. The remotely located control means 30 at ground surface-level controls the power communicated to the heat exchange means 800 and thereby controls the temperature of said environ within the forementioned desired temperature range which is conducive to insuring long life for the bearing means 400 and the lubricant 500 contained therein.

Figure 4:
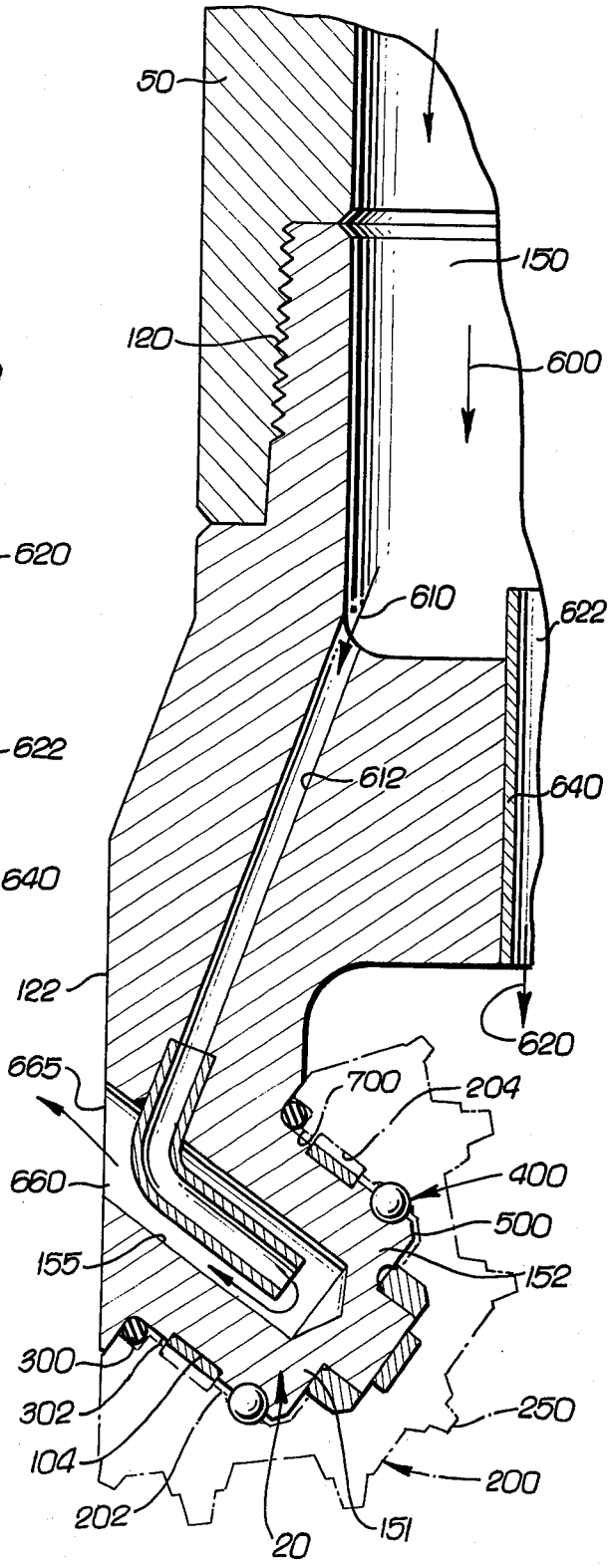
FIG. 4 is similar to FIG. 3 except the egress passageway is further adapted for both conventional heat transfer cooling and for thermodynamic expansion cooling of said supporting journal facial surface.

In a second alternate form of the preferred embodiment FIG. 4, the passageway system is adapted for cooling purposes by the rock drill main body 100 having an enlarged hollow cavity 660 defining an egress passageway so as to permit expansion of the cooling fluid 610 upon contact with the relatively warmer internal wall 155 of the supporting journal 151. Thus, the energy absorbed by the fluid 610 in contact with said warmer supporting journal internal wall surface 155 is additionally enhanced by thermodynamic expansion cooling of said journal internal wall surface 155.

Figure 5:
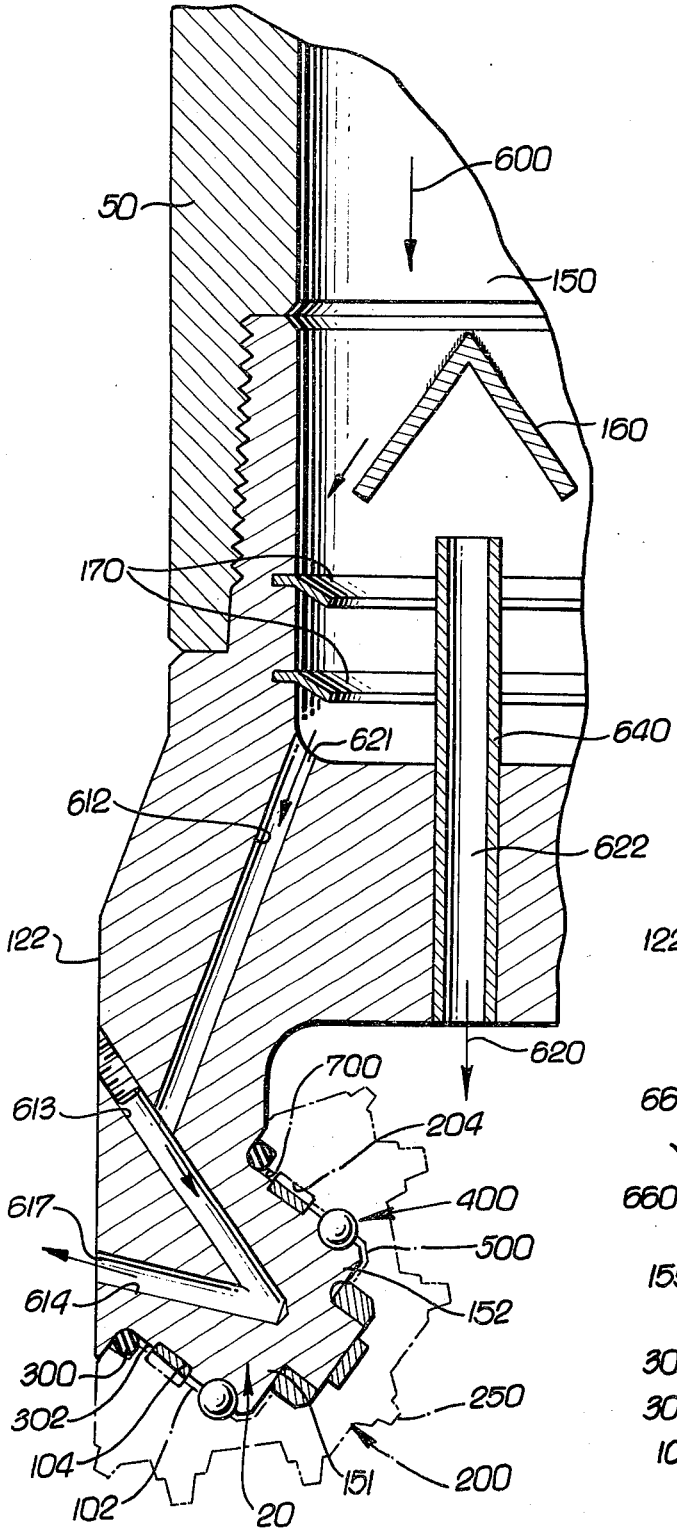
FIG. 5 is a fragmentary cross-sectional view of a rock drill bit assembly showing within the interior cavity of the rock drill main body a diverter and deflecter means adapted for separating water from the downhole fluid so that the fluid used for cooling the supporting journal facial surface has a relatively high water content.

In a third alternate form of the preferred embodiment FIG. 5, which is primarily used with a downhole fluid system adapted for cooling purposes, diverter means 160 and deflector means 170 are installed within the internal cavity 150 of the rock drill main body 100 so as to separate water from said downhole fluid 600.

This separated water is then collected in the bottom of said internal cavity 150 and then coursed through passageway 612, 613, 614 for cooling purposes, whereupon it exits 617 into the wellbore.

Cooling capacity can be substantially increased by utilizing the latent heat required to convert water from its liquid state to steam, in this and other alternate forms of the preferred embodiment, and this is a novel means in itself for providing temperature cooling regulation to bearing means 400 and lubricant 500 in a rock drill bit assembly 10.

Figure 6:
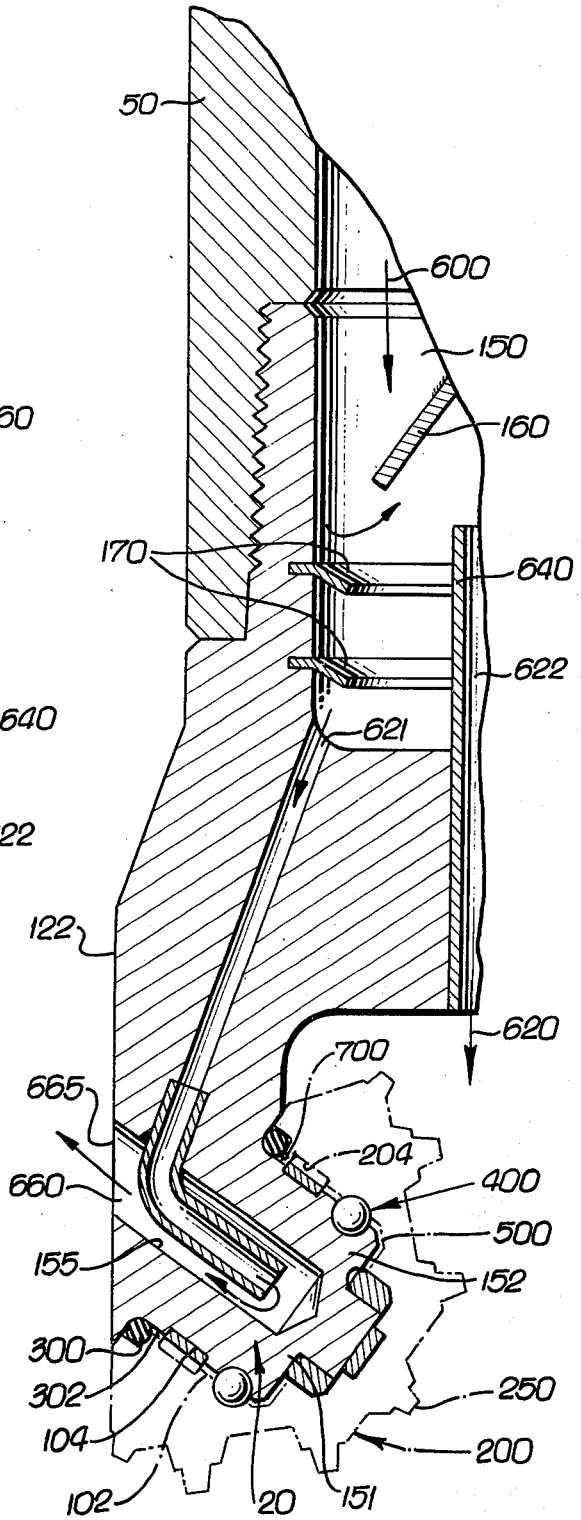
FIG. 6 is similar to FIG. 5 except the egress passageway is further adapted for both conventional heat transfer cooling and for thermodynamic expansion cooling of said supporting journal facial surface.

It should be noted that this method of cooling is further enhanced, if still additional cooling is needed, by adding a thermodynamic expansion chamber 660 as shown in FIG. 6.

A thermostatic device can also be added at passageway 612 entry opening 621 which is designed to open or close at a defined temperature level so as to assist in controlling the volume of fluid flow in passageway 612, 613, 614 and thus effect the cooling effect of the fluid flowing therethrough.

Figure 7:
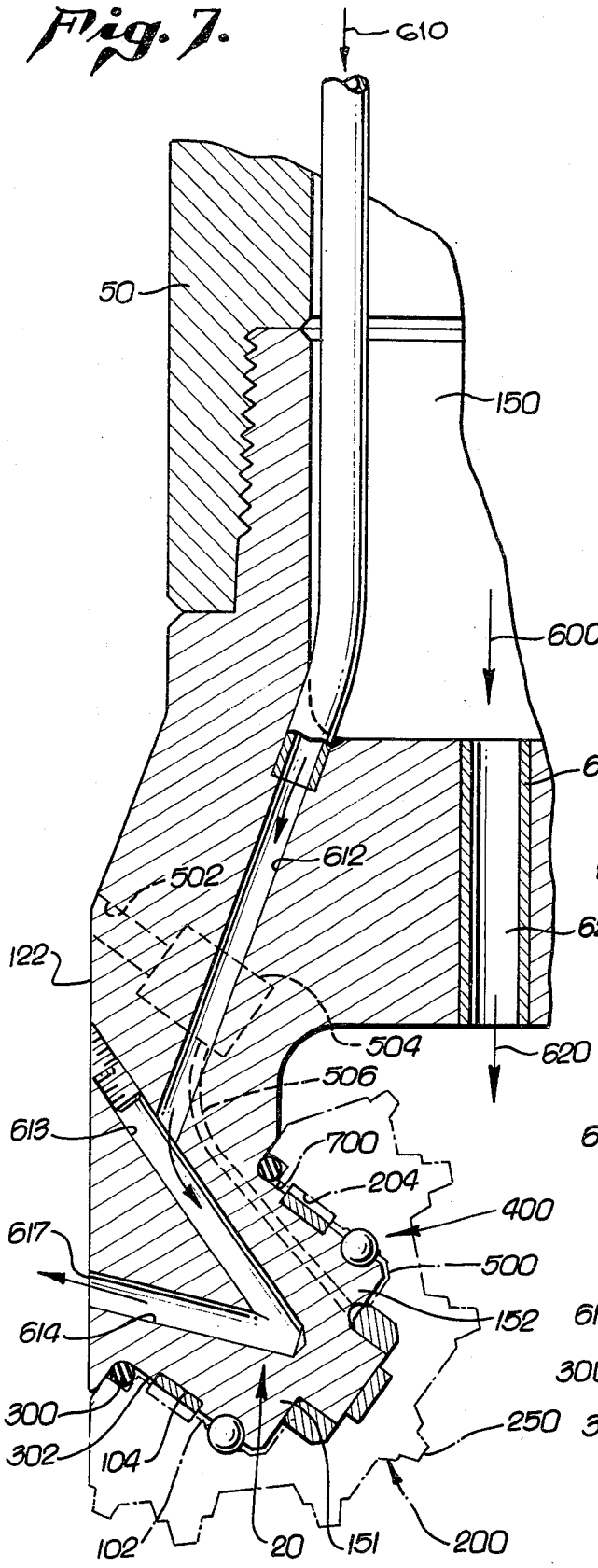
FIG. 7 is a fragmentary cross-sectional view of a rock drill bit assembly showing two independent passageway systems, one passageway circuit adapted to conduct downhole drilling fluid, and the second passageway circuit adapted to conduct a defined heat transfer fluid.

A fourth alternate form of the preferred embodiment uses a dual fluid system FIG. 7 which has two independent passageway circuits within the drill string assembly wherein in one passageway circuit the downhole drilling fluid 600 is coursed from a first ground surface-level source through the drill string 50 into the rock drill main body 100 where it performs only the function of exiting through a nozzle 640 which is adapted to direct the flow therefrom to clean the cone 200 cutting teeth 250 and to clean the bottom surface of the wellbore as it is bored. In the second passageway circuit, a second fluid 610 is coursed from ground surface-level through a second independent channel in the drill string 50 and then into the rock drill main body 100 where it courses through passageway 612, 613, 614 which is adapted to either cool or heat the supporting journal surface 102 of the rock drill main body 100, and then exit into the wellbore. Said second circulating fluid 610 having characteristics primarily adapted for cooling or heating purposes, while the first fluid 600 having characteristics primarily adapted for cleaning the cone 200 teeth 250 and the wellbore bottom surface during boring.

Figure 8:
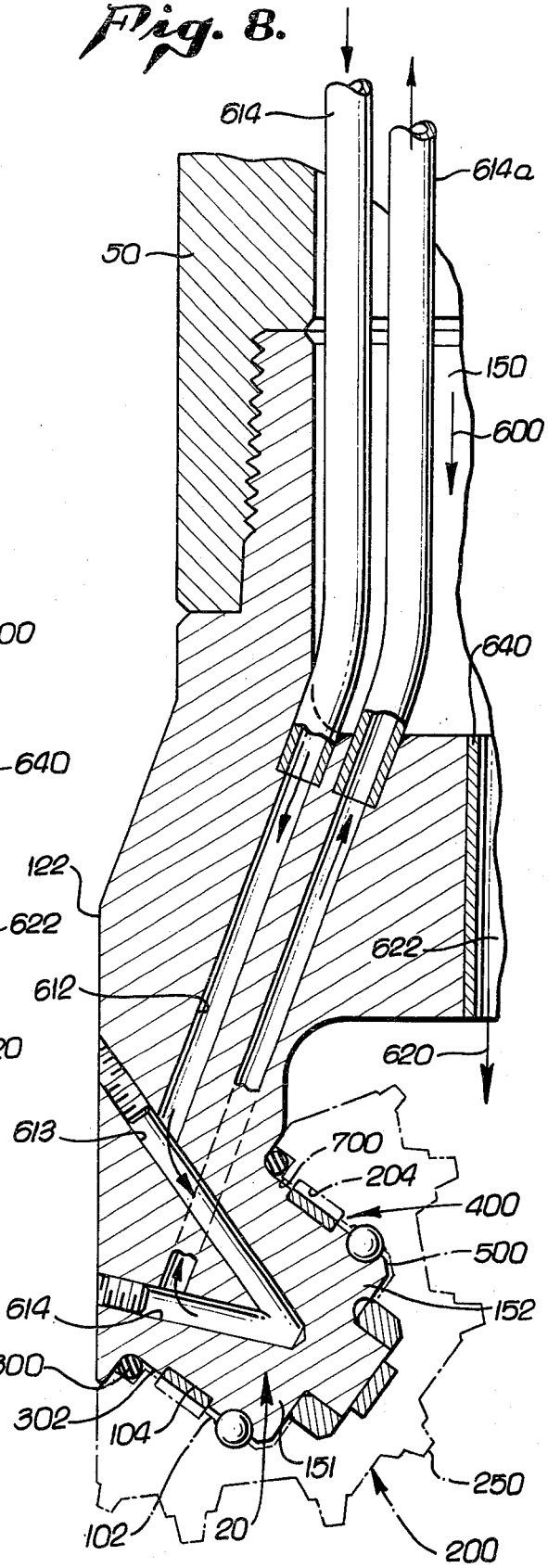
FIG. 8 is similar to FIG. 7 except the egress passageway for said defined heat transfer fluid does not exit into the wellbore but has a return conductive passageway adapted for coursing said defined heat transfer fluid back to its ground surface-level source.

In a fifth alternate of the preferred embodiment, FIG. 8, the dual fluid system in FIG. 8 is modified in that within the second passageway system, the second fluid 610 is coursed from ground surface-level through said second independent channel in the drill string 50 and then into the rock drill main body 100 where it courses through said passageway 612, 613, 614 which is adapted to either cool or heat the supporting journal surface 102 of the rock drill main body 100, but unlike the second alternate, the spent fluid is returned to the surface ground-level source through a connecting return path 614*a* which conducts the fluid back to the ground level-surface for reuse.

It will of course be understood that various changes may be made in the form, details, arrangement and proportions of the various steps of the method and the parts of the apparatus described in the embodiment herein, without departing from the spirit of the invention.

We claim:

1. A rock drill bit assembly adapted for boring in the earth, and comprising:

a rock drill main body having at least one journal;

a cone disposed about said journal and adapted to rotate relative thereto, said journal and cone having opposing facial surfaces, portions of which mutually define a clearance space therebetween;

bearing means positioned within said clearance space for rotatably supporting said cone relative to said journal; and heat exchange means for inducing the transfer of heat between said journal and a circulating fluid, said heat exchange means including a passageway within said journal for conducting said circulating fluid through said journal, said passageway being in close proximity to but physically separated from said opposing facial surfaces, and further including an expansion chamber means for permitting the thermodynamic expansion of said circulating fluid to increase the cooling capacity of said heat exchange means.

2. A rock drill bit assembly adapted for boring in the earth, and comprising:

a rock drill main body having at least one journal;

a cone disposed about said journal and adapted to rotate relative thereto, said journal and cone having opposing facial surfaces, portions of which mutually define a clearance space therebetween;

bearing means positioned within said clearance space for rotatably supporting said cone relative to said journal;

heat exchange means for inducing the transfer of heat between said journal and a circulating fluid, said heat transfer means comprising a fluid circulation system including an internal passageway within said rock drill main body for receiving said circulating fluid and conducting said circulating fluid in close proximity to but physically separated from said facial surfaces; and means associated with said fluid circulation system for separating liquid from a mist of gas and liquid and supplying the resultant separated liquid to said internal passageway.

3. A rock drill bit assembly adapted for boring in the earth, and comprising:

a rock drill main body having at least one journal;

an externally toothed cone disposed about said journal and adapted to rotate relative thereto, said journal and cone having opposing facial surfaces, portions of which mutually define a clearance space therebetween;

bearing means positioned within said clearance space for rotatably supporting said cone relative to said journal;

heat exchange means for inducing the transfer of heat between said journal and a circulating fluid, said heat exchange means including a first passageway system for conducting said circulating fluid into heat conducting relationship with the interior of said journal, said first passageway being physically separate from said opposing facial surfaces; and a second passageway system for conducting a drilling fluid into the vicinity of the exterior of said toothed cone; said first and second passageway systems being independent of one another so as to prevent the mixing of said circulating and drilling fluids within said systems.

4. A rock drill bit assembly of claim 3 including means for remotely controlling the operation of said heat exchange means.

5. The structure of claim 3 wherein said first passageway includes a return passageway which is adapted to conduct said circulating fluid away from said rock drill bit assembly.

6. A rock drill bit assembly adapted for boring a cylindrical borehole in the earth, and comprising:

a rock drill main body having at least one journal thereon;

a cone disposed about said journal and adapted to rotate relative thereto, said journal and cone having opposing facial surfaces, portions of which mutually define a clearance space therebetween;

sealed lubricated bearing means positioned within said clearance space for rotatably supporting said cone relative to said journal;

heat exchange means for inducing the transfer of heat between said journal and a moving fluid, said heat exchange means including a passageway extending within said journal and said rock drill main body for conducting said moving fluid from a source outside said rock drill bit assembly through said journal, the portion of said passageway within said journal extending in close proximity to but physically separated from said opposing facial surfaces, the egress of said passageway opening into said borehole at a location remote from said journal.

* * * * *